United States Patent [19]

Henrich

[11] 4,414,493

[45] Nov. 8, 1983

[54] LIGHT DIMMER FOR SOLID STATE BALLAST

[75] Inventor: William H. Henrich, Sparta, Tenn.

[73] Assignee: Thomas Industries Inc., Louisville, Ky.

[21] Appl. No.: 309,086

[22] Filed: Oct. 6, 1981

[51] Int. Cl.[3] ..... G05F 1/00; H05B 37/02

[52] U.S. Cl. ..... 315/308; 315/149; 315/219; 315/DIG. 4

[58] Field of Search ..... 315/308, 208, DIG. 4, 315/219, 149

[56] References Cited

U.S. PATENT DOCUMENTS

| | | | |
|---|---|---|---|
| 3,047,789 | 7/1962 | Lowry | 315/DIG. 4 |
| 3,541,421 | 11/1970 | Buchman | 315/308 |
| 3,681,654 | 8/1972 | Quinn | 315/DIG. 4 |
| 3,684,919 | 8/1972 | Cramer | 315/DIG. 4 |
| 3,719,858 | 3/1973 | Gilbreath | 315/308 |
| 3,885,197 | 5/1975 | Moses | 315/308 |
| 4,210,846 | 7/1980 | Capewell | 315/121 |
| 4,251,752 | 2/1981 | Stolz | 315/208 |
| 4,277,728 | 7/1981 | Stevens | 315/308 |
| 4,287,468 | 9/1981 | Sherman | 315/DIG. 4 |
| 4,356,433 | 10/1982 | Linden | 315/208 |

*Primary Examiner*—Harold A. Dixon

*Attorney, Agent, or Firm*—Emrich, Lee, Brown & Hill

[57] ABSTRACT

A system for controlling the current in a solid state, high frequency ballast energizing a gaseous discharge lamp for providing light dimming therein is disclosed. The ballast includes a thyristor/capacitor inverter bridge for generating the lamp current which is regulated by a commutation circuit synchronized with zero crossings of the thyristor current. Lamp current and voltage level signals are fed back to the commutation circuit for proper lamp current regulation. A dimming signal is added to either the lamp current feedback or voltage feedback signal and this composite signal is provided to the lamp current regulator in varying the bias thereof for selectively controlling light intensity. Dimming may be accomplished either manually by means of a rotatable switch having an output which varies linearly with shaft rotation or automatically by means of an ambient light level sensor to provide a predetermined output light level which may be manually adjusted. A common isolated control line facilitates photosensing control in a multiple ballast/light system with inter-ballast and ground isolation provided by optoisolators. In a preferred embodiment, a user adjustable balanced bridge is responsive to either manual or light level-dependent automatic control inputs for varying the bias of an input amplifier of the lamp current regulator.

12 Claims, 7 Drawing Figures

FIG. 3
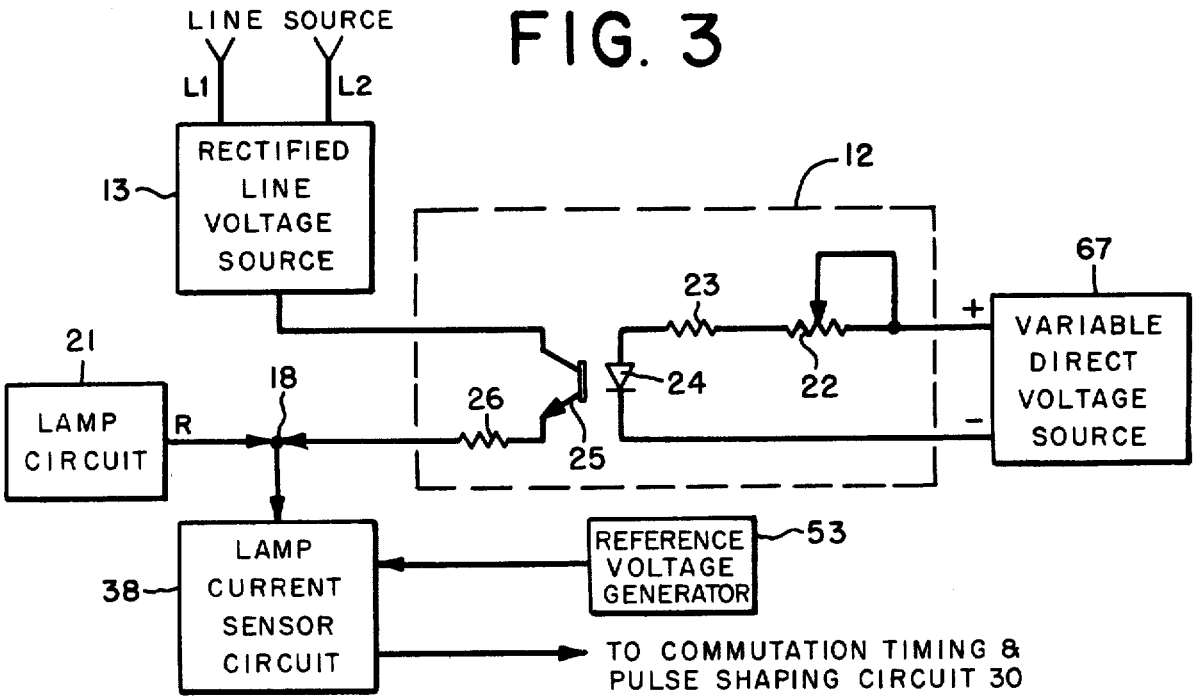
FIG. 4
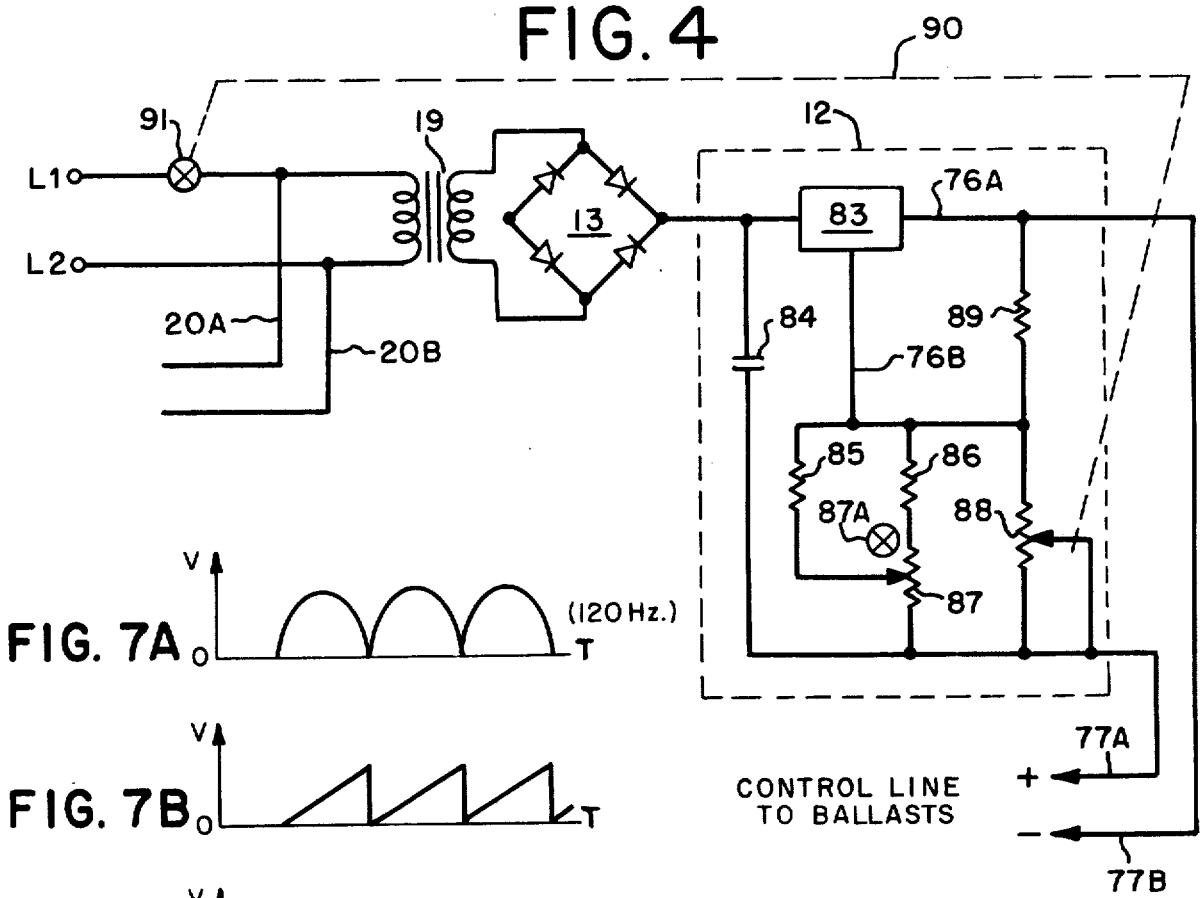
FIG. 7A
FIG. 7B
FIG. 7C
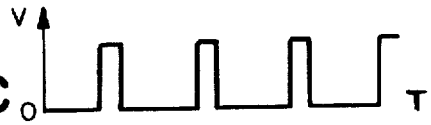

LIGHT DIMMER FOR SOLID STATE BALLAST

CROSS-REFERENCE TO RELATED APPLICATION

The present invention is related to co-pending, co-owned U.S. patent application Ser. No. 194,783, entitled "SOLID STATE BALLAST", filed Oct. 7, 1980, the disclosure of which is expressly incorporated herein by reference.

BACKGROUND OF THE INVENTION

This invention relates generally to a ballast for energizing gaseous discharge lamps and is specifically directed toward a light dimming control system for regulating the output to gaseous discharge lamps provided by a solid state, high frequency ballast.

The typical fluorescent tube employs a gas confined in a sealed cylinder of glass incorporating a heating filament at either end. A voltage applied to the filament causes thermionic emission therefrom in initiating and sustaining an arc across the tube, causing the gas to ionize and produce radiation. This radiation activates the fluorescent coating on the inner surface of the glass tube, producing illumination. Generally, mercury vapor is utilized in a fluorescent tube. The same principle is employed, without the fluorescent effect, in high-intensity discharge (HID) lamps.

A variable dimming capability in gaseous discharge lamps is desirable for providing a range of lighting conditions and to reduce lamp intensity for conserving energy when possible. Since fluorescent and HID lamps are constant voltage drop devices, the brightness of the lamp is varied by controlling the current provided thereto. Since the filament voltage must be maintained at a predetermined level to sustain the arc across the tube, difficulties arise when attempts are made to provide a variable dimming capability for the lamp. Prior art systems generally employ a ballast arrangement having a high leakage reactance capable of providing lamp voltage regulation over a range of input and lamp currents. However, the aforementioned difficulties are encountered particularly where the lamp circuit draws low current, for these circuits are then subject to line voltage fluctuation resulting in excessive flicker in light output.

Recent work has been directed toward the development of solid state ballasts for energizing gaseous discharge lamps. This type of ballast would offer obvious advantages over prior art devices, e.g., increased reliability, reduced expense, and increased energy efficiency. However, various technical and economic factors have contributed to the lack of a commercial solid state, high frequency ballast, or inverter, for gaseous discharge lamps. Nevertheless, advances in this area have been made as evidenced by the co-pending patent application, Ser. No. 194,783, referenced above. The present invention is intended to provide a variable dimming capability in particular for the solid state ballast disclosed therein and for any solid state ballast incorporating the general features thereof.

SUMMARY OF THE INVENTION

The present invention is intended to overcome the aforementioned limitations and, therefore, represents an improvement over the prior art.

Briefly, the present invention provides for either the manual or automatic control of the output of a solid state, high frequency ballast energizing a gaseous discharge lamp in providing for the dimming thereof. The solid state ballast includes a thyristor/capacitor inverter bridge which energizes the lamp circuit with a high frequency oscillating voltage derived from full-wave rectified line voltage. Lamp current as regulated by a commutation timing and pulse-shaping circuit which derives its timing from, and is synchronized with, zero crossings of the thyristor current. The commutation timing and pulse-shaping circuit has an inherent minimum delay for each zero crossing of the thyristor current to permit the thyristors to commutate during each cycle of high frequency oscillation. An output signal of a lamp current sensing amplifier delays firing or commutation of the thyristors beyond the previous zero crossings as a function of increasing lamp current. Similarly, when lamp current is at a relatively low value, the commutation time of the power thyristors is advanced by means of the output of the current sensing amplifier in adding energy to the oscillating circuit feeding current to the lamps.

In one embodiment, a dimming control signal is added to a lamp current detection signal with the resulting composite signal provided to the commutation timing and pulsed shaping circuit which then delays the firing or commutation of the thyristors beyond the previous zero crossing in response to either increasing lamp current or the dimming signal input. The dimming signal may be provided either manually in response to a user-operated switch or automatically by ambient light level sensing means to provide a predetermined output light level. The present invention may be used for dimming a single lamp or a plurality of lamps with inter-ballast and ground isolation provided by opto-isolators.

In one embodiment having automatic light dimming control, the output of a balanced bridge having a phototransistor in one branch thereof is provided to the commutation timing and pulse-shaping circuit for controlling thyristor operation. The light level to which the system automatically regulates is manually adjustable by setting the resistance in the bridge's other branch as desired.

Another embodiment of the lamp dimmer control circuit of the present invention includes a pulse generator for digitally controlling lamp intensity. By providing pulsed control signals to optoisolators in the ballast, the effect of optoisolator drift due to temperature variations is minimized.

BRIEF DESCRIPTION OF THE DRAWINGS

The appended claims set forth those novel features believed characteristic of the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 3 shows a dimming circuit for a gaseous discharge lamp incorporating isolation between the lamp dimming signal and the lamp energizing signal;

FIG. 4 is a schematic diagram, partly in functional block form, of a continuously variable dimming control circuit for a gaseous discharge lamp in accordance with the present invention;

FIGS. 7A–7C show the signal waveforms at various locations in the digital embodiment of the dimmer control circuit shown in FIG. 6.

DETAILED DESCRIPTION OF THE PREFERRED EMBODIMENTS

Figure 1:
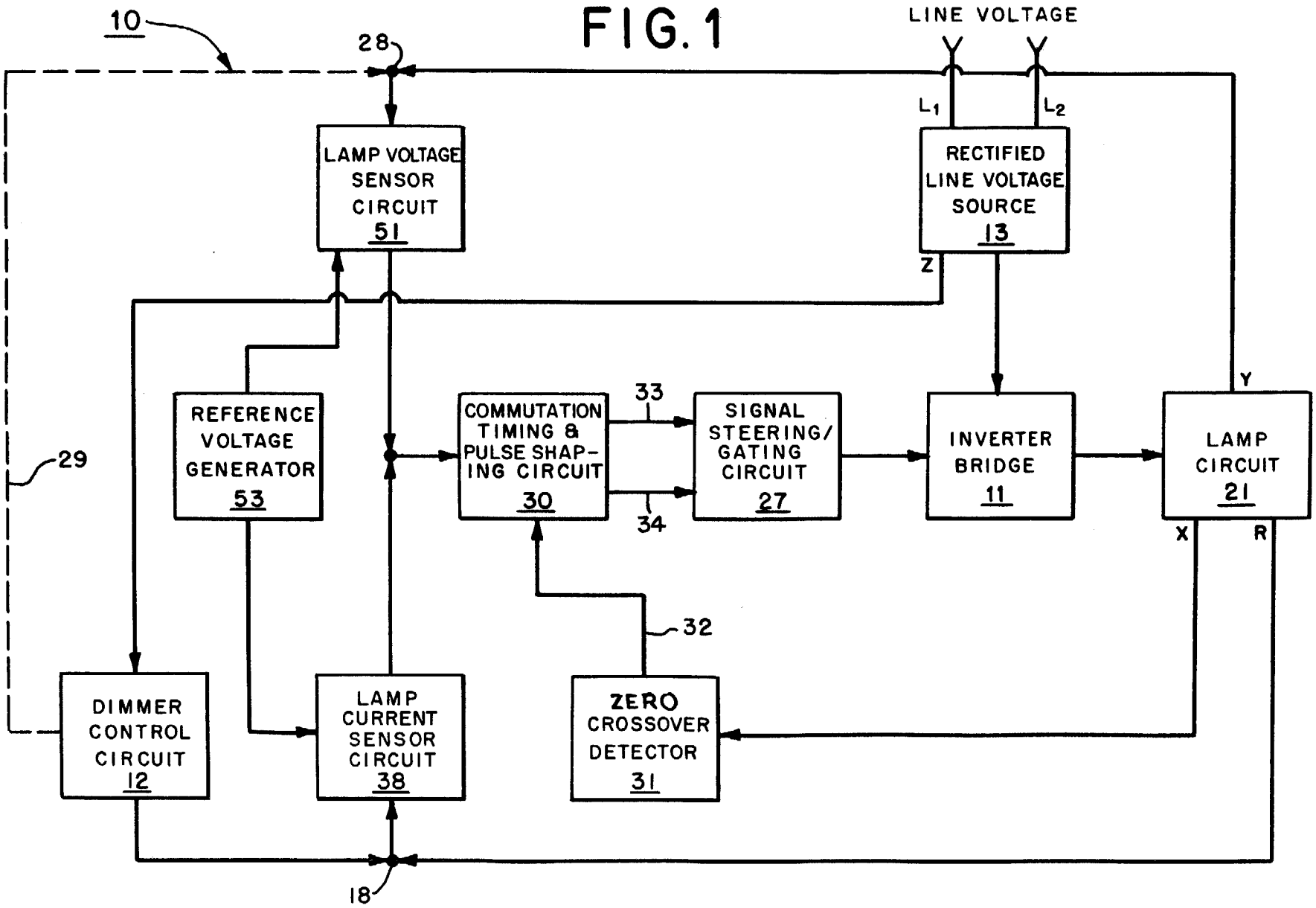
FIG. 1 is a generalized block diagram of a solid state ballast for energizing a gaseous discharge lamp having a variable light dimming control in accordance with the present invention.

Referring to FIG. 1, there is shown in simplified block diagram form a light dimmer for a solid state ballast 10 for controlling the intensity, or brightness, of gaseous discharge lamps in accordance with the present invention. A full-wave rectifier 13 receives standard line power, e.g., 60 Hz, via lines L1 and L2 and converts it to a full-wave rectified output signal. The rectified output signal is then provided to an inverter bridge 11 and to a dimmer control circuit 12. The latter output signal from full-wave rectifier 13 is designated as Z.

Inverter bridge 11 includes first and second thyristors with commutating diodes (not shown) connected respectively across the power thyristors in opposite polarity to limit any inverse voltage across the thyristors. A series resistance/capacitance circuit is connected across each thyristor to limit the rate of change of voltage. Since such circuits are known in the art, being commonly referred to as "snubber" circuits, the details of inverter bridge 11 are not provided herein. A detailed description of the operation of an inverter bridge compatible with the present invention can be found in the above-referenced patent application.

Inverter bridge 11 provides a high frequency output signal for driving a lamp circuit 21 in energizing the gaseous discharge lamps. Control logic circuitry in the form of a commutation timing and pulse-shaping circuit 30 receives timing information and a clock input via line 32 from a zero crossover detection circuit 31, the input signal to which is a signal designated X provided by lamp circuit 21. The signal thus provided by lamp circuit 21 to zero crossover detector 31 represents the phasing of the current in the inverter bridge 11. At each zero crossover of thyristor current (whether the current is crossing over from a positive to a negative polarity or from a negative to a positive polarity), the zero crossover detection circuit 31 clocks the commutation timing and pulse-shaping circuit 30 over a line designated 32 in FIG. 1. The output signal of the commutation timing and pulse-shaping circuit 30 is a binary signal having complementary polarities respectively on output lines 33 and 34 which are the $\overline{Q}$ and Q outputs of the commutation timing and pulse-shaping circuit 30. The output signal of commutation timing and pulse-shaping circuit 30 is provided to signal steering/gating circuit 27. The output signals from signal steering/gating circuit 27 are provided to a transformer (not shown) in inverter bridge 11 to generate a first signal to cause a first thyristor to conduct or to generate a second signal to cause a second thyristor in inverter bridge 11 to conduct. Signal steering/gating circuit 27 thus clocks the output of commutating timing and pulse-shaping circuit 30 to inverter bridge 11 in steering the output pulses therefrom ultimately to one of the power thyristors in inverter bridge 11, thereby generating the oscillating mode of the high frequency inverter. The frequency of oscillation is determined primarily by the resonance of power bridge capacitors (not shown) and the inductance in a transformer (not shown) delivering current to lamp circuit 21. A detailed discussion of the operation of commutation timing and pulse-shaping circuit 30 and signal steering/gating circuit 27 is provided below.

A signal denoted R is derived in the lamp load circuit 21 which is representative of the high frequency lamp current. A signal denoted Y is generated by means of the lamp circuit 21 and is representative of the voltage in the inverter bridge 11. The former signal R is provided to lamp current sensor circuit, the output of which is coupled as an input signal to the commutation and timing pulse-shaping circuit 30 and, as will be explained more fully below, acts to lengthen the width of the pulses provided to signal steering/gating circuit 27 as lamp current values increase, or to shorten the width of that pulse as sensed lamp current decreases. By increasing the width of the pulses provided by commutation timing and pulse-shaping circuit 30 to signal steering/gating circuit 27 the succeeding commutation time is delayed, and energy coupled to the power stage is reduced; and by decreasing its width, output power is increased. In this manner, the lamp current is regulated. Similarly, the signal designated Y which is representative of the voltage in the inverter bridge 11 is coupled to a lamp voltage sensor circuit 51, the output of which is also fed to the input of the commutation timing and pulse-shaping circuit 30 to extend the width of the pulses provided to signal steering/gating circuit 27 and thereby delay turning the thyristors in inverter bridge 11 on as the magnitude of the sensed voltage increases. This reduces the voltage applied to the lamps during warm-up and extends lamp life.

Rectified line voltage source 13 also provides a DC output to a dimmer control circuit 12 which, in turn, provides either a user-initiated or automatically controlled dimmer control signal to junction 18 and thence to the lamp current sensor circuit 38. In this manner, the dimmer control signal is added to the lamp current sensor signal from the lamp circuit 21, with the resulting composite signal provided to the lamp current sensor circuit 38. Lamp current sensor circuit 38 then provides a control signal to the commutation timing and pulse-shaping circuit 30, as previously described, for regulating the current in the lamp circuit 21.

An alternative embodiment of the present invention involves providing the dimmer control signal from dimmer control circuit 12 to point 28 via line 29 (shown in dotted line form in FIG. 1). The output of dimmer control circuit 12 thus forms a composite signal with the inverter voltage feedback signal Y, which composite signal is provided to the lamp voltage sensor circuit 51. Lamp voltage sensor circuit 51 thence provides a control signal to the commutation timing and pulse-shaping circuit 30 as previously described. This control signal is in response to either a dimmer control signal provided by the dimmer control circuit 12 or the output Y from the lamp circuit 21 representing the voltage in inverter bridge 11. In either case, the signal provided by the lamp voltage sensor circuit 51 to the commutation timing and pulse-shaping circuit 30 acts to regulate the current in the lamp circuit 21. Thus, the dimmer control circuit 12 may be coupled to either the lamp current sensor circuit 38 or the lamp voltage sensor circuit 51 for providing a dimming control signal in regulating lamp current to provide a desired lamp output. A reference voltage generator 53 is coupled to both the lamp current sensor circuit 38 and the lamp voltage sensor circuit 51 in providing a reference voltage signal for comparison with the respective inputs thereto.

Figure 2:
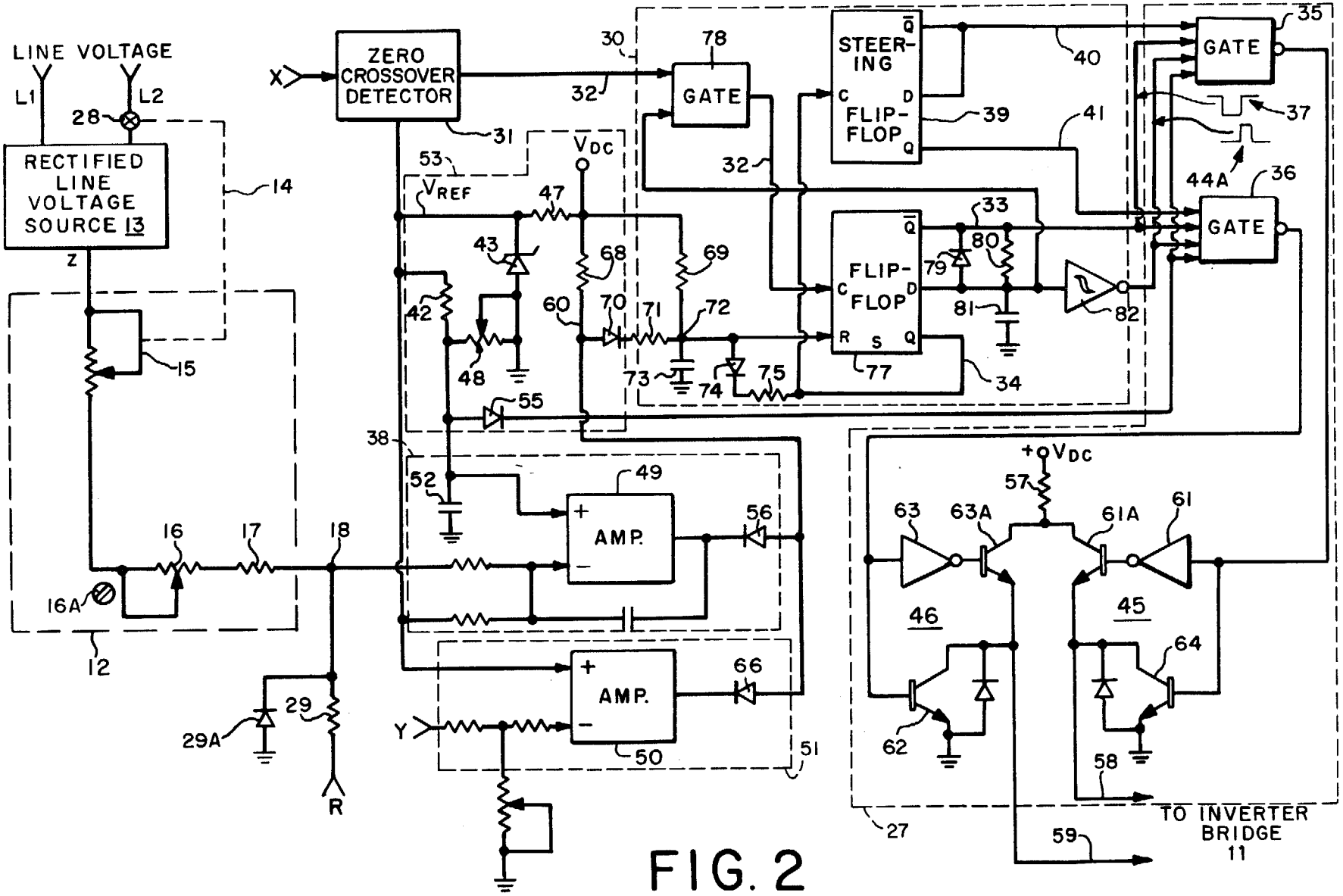
FIG. 2 is a schematic diagram, partly in functional block form, showing the details of a dimming circuit energized by a rectified line voltage in combination with a lamp current sensor circuit and ballast drive circuitry in a preferred embodiment of the present invention.

Referring to FIG. 2, there is shown a schematic diagram, partly in functional block form, of a dimmer control circuit 12 for providing a variable dimmer control signal to logic and control circuitry for causing the gaseous discharge lamps to operate at a desired brightness level. The line voltage is provided via L1, L2 to the rectified line voltage source 13 which provides a DC output signal designated Z to the dimmer control circuit 12. Dimmer control circuit 12 includes variable resistances 15, 16 and a fixed resistance 17. The DC output of dimming control circuit 12 is provided to junction 18 where it is combined with the lamp current sensor signal R to form a composite signal. The inclusion of resistance 17 permits the two signals to be added in forming the composite output signal provided to the lamp current sensor circuit 38. A set-screw adjustment 16A of variable resistance 16 permits the minimum level of the output signal to be set as desired, thus establishing the lower end of the selectively variable lamp intensity, or brightness. Desired lamp intensity may be manually selected by means of variable resistance 15. In a preferred embodiment, variable brightness control resistance 15 is coupled by means of line 14 to an ON/OFF switch 28 which is coupled to the AC input via line L2.

The AC feedback signal R from the lamp circuit 21 provided to the lamp current sensor circuit 38 is first rectified by resistance 29 and grounded diode 29A. At junction 18 this rectified signal is then added to the dimming control signal in producing a composite signal which is provided to the lamp current sensor circuit 38.

As previously indicated, a signal designated X is provided by lamp circuit 21 to zero crossover detector 31. This signal represents the timing or phasing of the current in lamp circuit 21. The output of zero crossover detector 31 is then clipped and provided to one input of gate 78. Unless otherwise indicated, a "gate" as used herein is a NAND gate. The other input of the gate 78 is received from a pulse-shaping circuit (to be described) connected to the $\overline{Q}$ output of a "D-type" flip-flop 77 which is part of the commutation timing and pulse-shaping circuit 30. The output of the gate 78 is fed to the clock input C of the flip-flop 77.

The D output of flip-flop 77 is connected to the $\overline{Q}$ output of the same flip-flop by means of a diode 79 in the polarity shown and a resistor 80. A capacitor 81 is connected between the D output of flip-flop 77 and ground. As will be described more fully below, it is this circuitry which determines the width of the output pulse that causes the thyristors to conduct. The output of this pulse shaping circuit is also connected to an input of gate 78.

The Q output of flip-flop 77 is connected to the clock input of steering flip-flop 39 and is also connected by means of a resistor 75 and a diode 74 to a junction 72 which is directly connected to its own reset input.

A capacitor 73 is connected between the junction 72 and ground; and a resistor 69 is connected between a low voltage supply $V_{DC}$ and the junction 72. A diode 70 and a resistor 71 are connected between a junction 60 and the junction 72; and a resistor 68 is connected between the low voltage power supply $V_{DC}$ and the junction 60.

The lamp current sensor circuit 38 includes a linear differential amplifier 49 having its positive input terminal connected to a reference voltage derived from the reference voltage generator 53, and including a capacitor 52 connected to ground. The negative input terminal of the amplifier 49 is connected through a bias network to the previously described composite signal comprised of the dimming control signal and the signal R derived from the lamp circuit. The output of the amplifier 49 is connected by means of a diode 56 to the junction 60.

The lamp voltage sensor circuit 51 includes a similar differential amplifier 50 having its positive input terminal connected directly to the reference voltage and its negative input terminal connected through a bias network to the previously described signal Y. The output of the amplifier 50 is connected by means of a diode 66 to the junction 60.

The reference voltage generator 53 includes a dropping resistor 47 directly connected to the low voltage power supply, $V_{DC}$, and is derived across a Zener diode 43. The reference at the positive input of amplifier 49 includes a fixed resistor 42 and a potentiometer 48, the junction between which is directly connected by means of a diode 55 to the output of a counter circuit (not shown).

By setting a gate (not shown) in the zero crossover detection circuit 31 each time the thyristor current in inverter bridge 11 crosses zero, a pulse may be transmitted to gate 78 and fed through gate 78 to clock flip-flop 77. Thus, flip-flop 77 is clocked every time the thyristor current crosses zero. In other words, the flip-flop 77 is clocked twice for each complete cycle of inverter oscillation.

Under normal operation, the Q output of flip-flop 77 is a logic "0" (that is, relatively low voltage or ground level). In this state, the junction 72 is held at a "0" by diode 74. When flip-flop 77 is clocked, its Q output becomes a logic "1". This signal clocks the steering flip-flop 39 and also removes the clamp from capacitor 73 by reverse biasing diode 74. Thus, capacitor 73 begins to charge toward a level $V_{DC}$. The amount of time that it takes for the junction 72 to charge to a potential that will reset flip-flop 77 depends not only on the values of resistor 69 and capacitor 73, but also on the values of resistors 68 and 71, and the potential at junction 60. The signal at junction 60 is the output of amplifiers 49, 50 coupled through diodes 56, 66, respectively, which diodes act as an OR gate.

If the current flowing in the lamps is relatively high (in relation to a nominal or design value), then the signal R will also be relatively great, thereby causing the output of amplifier 49 to decrease. This will cause the voltage at junction 60, coupled through diode 56, to decrease and thereby increase the charge time of capacitor 73 by reducing its charging current. Since it is the voltage on capacitor 73 that resets flip-flop 77, the longer it takes to charge the capacitor 73, the longer will be the delay (or "commutation time") between a zero crossing detection and the gating or commutation of the thyristor which has been selected by the steering flip-flop 39. To summarize, the greater the lamp current, the longer will be the delay time for resetting flip-flop 77. A longer delay time reduces lamp current in the next half cycle of inverter oscillation. When this delay reaches sufficient magnitude to reset the flip-flop 77, the $\overline{Q}$ output of that flip-flop goes positive. From the foregoing, it will be appreciated that the timing of the resetting of flip-flop 77 varies within a range having a minimum time (corresponding to a low value of sensed lamp current) which is determined by the values of resistors 68 and 71 as well as resistor 69 and capacitor 73, to a maximum time which is determined by the value of resistor 69 and capacitor 73 alone. The minimum time of this range is greater than the turn off time of the thyristors so that they can be commutated off before a new cycle begins. When the flip-flop 77 is reset by the charging of capacitor 73, the signal on the $\overline{Q}$ output returns to logic "1". This signal is fed to the gates 35, 36 as an enable signal. This causes the output of gate 36 to go to "0" assuming flip-flop 39 has a "1" on its Q output. This same signal also causes capacitor 81 to begin to charge through resistor 80. When the voltage on capacitor 81 is sufficient to change the state of the Schmitt trigger circuit 82, its output goes to "0". Thus, the width of the output signal is determined by the values of the resistor 80 and capacitor 81, which are selected so that the output signal has a nominal width of four microseconds, sufficient to gate the thyristors on. The gates 35, 36 are enabled in alternate half cycles of the inverter current by the output of the steering flip-flop 39. It will be observed that in the next succeeding half cycle of inverter current, an actuating pulse is transmitted through gate 35.

When the flip-flop 77 is reset, the Q output goes to logic zero, thereby clamping capacitor 73 again. The function of gate 78 is to prevent successive triggers from clocking flip-flop 77, and thereby reduce the sensitivity of the system to spurious signals or noise. Thus, the output signals of the gates 35, 36 are each normally a logic "1". When all of the inputs to one of these gates become logic "1", the output goes to a logic "0". This signal is coupled to the dual drivers 45, 46 to generate the thyristor gating signal. For example, when the output of gate 35 goes to "0", it is fed through an inverter 61 to cause a transmitter 61A to conduct, thereby coupling the positive voltage of supply $V_{DC}$ to line 58. Since the output of gate 36 is a "1" at this time, the line 59 is coupled to the circuit common through a conducting transistor 62. Similarly, when the output of gate 36 goes to "0", the polarity of the signal on lines 58, 59 is reversed by inverter 63 and transistor 63A while lead 58 is connected to common by transistor 64. A similar regulating effect on thyristor current is obtained from the amplifier 50 which comprises the principal element of the lamp voltage sensor circuit 51.

The negative input to the amplifier 50 is received through a biasing network (not shown) as the signal Y. The diodes 56, 66 isolate the outputs of differential amplifiers 49, 50 from the junction 60. The circuitry just described permits whichever signal is lower from the amplifiers 49, 50 to have an effect on the charge time of capacitor 73. In normal operation, it is the output of the lamp current sensor circuit 38 which defines the charge time of capacitor 73, and thus the commutation time of the thyristors.

Figure 5:
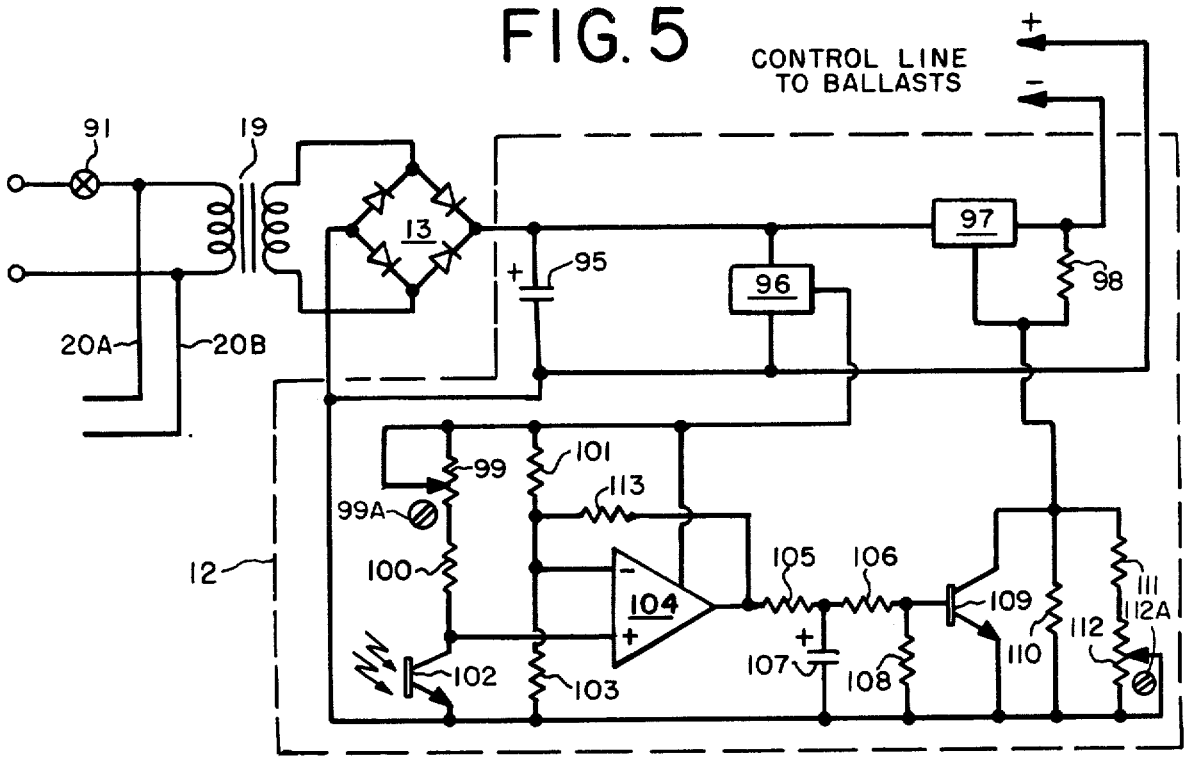
FIG. 5 shows a dimmer control circuit for a gaseous discharge lamp in accordance with the present invention wherein automatic control of lamp output is provided by means of an ambient light sensor.

FIGS. 3, 4 and 5 show several preferred embodiments of the dimmer control circuit 12 of the present invention. Referring to FIG. 3, there is shown a dimmer control circuit 12 which provides isolation between the dimming control signal source and the lamp drive circuit. Opto-isolators are used for providing the necessary isolation between the control circuitry and the "hot" lamp circuit where multiple ballasts are to be dimmed. With a voltage provided from rectified line voltage source 13 to phototransistor 25, a current flows therein which is a function of the current through the input light emitting diode (LED) 24. LED 24 is coupled to a variable direct voltage source 67 by means of fixed resistance 23 and variable resistance 22. The variable direct voltage source 67 provides a user controlled input signal source to dimmer control circuit 12 in providing a lamp dimming control capability. Variable resistance 22 allows minimum lamp intensity to be selectively established. LED 24 is coupled to phototransistor 25 optically only and is electrically isolated from it. Control is exercised by controlling the current through LED 24 by means of variable direct voltage source 67. Resistance 23 performs a current limiting function while resistance 26 coupled in series between phototransistor 25 and junction 18 provides for the adding of the output of dimmer control circuit 12 and the lamp current sensor signal from the lamp circuit 21. In a preferred embodiment, variable direct voltage source 67 provides a maximum voltage of 24 VDC which establishes the maximum lamp dimming level. The composite output signal from lamp circuit 21 and dimmer control circuit 12 is provided to lamp current sensor circuit 38 where it is compared with a reference voltage from the reference voltage generator 53 with an output signal provided to the commutation timing and pulse-shaping circuit 30 in response to this signal comparison.

Referring to FIG. 4, there is shown a manually controlled dimmer circuit in accordance with another embodiment of the present invention. The line voltage is provided via lines L1, L2 to transformer 19 which provides the desired voltage level to rectified line voltage source 13. In a preferred embodiment, the AC line voltage is provided to transformer 19 which, in turn, provides a 24 VAC output to rectified line voltage source 13 for providing a 24 VDC signal to dimmer control circuit 12.

Included in dimmer control circuit 12 is variable resistance 88 by means of which the lamp intensity may be selectively varied. A manual ON/OFF switch 91 is coupled to line L1 from the AC source and is also connected to variable resistance 88 by means of line 90. This permits ON/OFF control of the lamp by means of a switch included in the AC input line.

Variable resistance 87 establishes the minimum light level output of the lamps and is controlled by means of a screwdriver conrol 87A. Capacitor 84 provides filtering for the dimming control signal which may be provided via control lines 77A, 77B to a plurality of ballasts each energizing an associated lamp circuit. Thus, the dimmer control circuit 12 of FIG. 4, may be utilized to control the brightness of either a single gaseous discharge lamp or to simulataneously control the brightness of a plurality of gaseous discharge lamps. Since it is desirable that the lamp control signals from the ballasts vary with the shaft rotation of potentiometer 88, a linear relationship should exist between the displacement of the contact along variable resistance 88 and the magnitude of the dimming control signal provided via lines 77A, 77b to the ballasts. In order to provide this linear relationship, voltage regulator 83 is incorporated in dimmer control circuit 12. Voltage regulator 83 operates so as to regulate the output voltage provided to the control line so that the potential between the output voltage and the control terminal voltage of voltage regulator 83 is equal to a reference voltage which is characteristic of the voltage regulator 83 itself. One requirement of voltage regulator 83 is that a minimum current is required to flow through the regulator. This requirement is provided by connecting a resistor 89 between the output and control lines 76A and 76B, respectively, with resistor 89 thus forming a part of the voltage divider network across the output of voltage regulator 83. The other half of the voltage divider network is comprised of the equivalent resistance of fixed resistances 85, 86 and variable resistances 87, 88. The resistive network comprised of resistances 85, 86, 87 and 88 facilitates the adjustment of the maximum voltage by resistance 87 for maximum lamp dimming and linearizes the output signal conrolled by variable resistance 88. Lines 20A, 20B may be coupled to the AC input lines L1, L2 if ballast loading is greater than the current-/voltage rating of manual switch 91. Lines 20A, 20B may lead to another ballast circuit or to a slave relay for energizing a higher power ballast circuit, if desired.

Referring to FIG. 5, there is shown a light dimming system for a ballast which provides automatic and manual control of lamp intensity. As in FIG. 4, the AC input is provided via transformer 19 to opposite diagonal nodes of full wave rectified line voltage source 13. The DC output from rectified line voltage source 13 is provided from opposite diagonal nodes of that rectifier circuit to dimmer control circuit 12.

Dimmer control circuit 12 includes a voltage regulator 97 which regulates the output voltage on line 77B, so that the potential between the output signal level on line 77B and the control signal level provided via line 97A is equal to the voltage regulator's reference voltge. This is accomplished by coupling resistor 98 across the output and the control lines 77B and 97A, respectively, of voltage regulator 97.

Automatic lamp intensity control is provided by phototransistor 102 which is responsive to the ambient light level. Variable reistance 99 which is controlled by means of rotary selector 99A establishes a predetermined light level provided by the gaseous discharge lamps. Lamp output in order to provide this light level is, of course, dependent upon ambient light level as detected by phototransistor 102. Similarly, variable resistance 112, the value of which is set by rotary selector 112A, establishes the maximum dimming level, or minimum intensity, of the lamps.

Phototransistor 102 forms one arm of a balanced bridge circuit with the other arm comprised of resistances 99, 100, 101 and 103. The bridge circuit comprised of phototransistor 102 and the aforementioned resistances is connected to the inputs of operational amplifier 104 which controls the current through transistor 109. By by-passing current through transistor 109 and disconnecting the control arm of variable resistance 99 from rotary switch 91, network effective resistance, or the voltage drop acros the network, is reduced and automatic control of the ballast is made possible. Thus, the output of phototransistor 102 changes with ambient light level, unbalancing the inputs to operational amplifier 104 causing transistor 109 to conduct. Resistance 113 provides negative feedback to limit the gain of the system.

Resistances 105, 106 and 108 in combination with capacitor 107 limit the speed of response of the automatic light level control system and allow cut-off of transistor 109. A resistive network comprised of resistors 110, 111 and variable resistance 112 is coupled to the output of transistor 109 and permits the desired minimum lamp intensity to be manually set by means of rotary selector 112A. The automatic light level control signal is provided via line 114 to voltage regulator 97 and thence to the lamp ballast, or ballasts, via line 77B.

Capacitor 95 filters the output of rectified line voltage source 13 while voltage regulator 96 provides a stabilized voltage for the bridge circuit comprised of phototransistor 102 and resistances 99, 100, 101 and 103. In addition, voltage regulator 96 provides a stabilized voltage for operational amplfiier 104. The control output voltage provided by voltage regulator 97 varies so as to maintain the aforementioned bridge in balance. By changing the value of variable resistance 99, the balanced condition of this bridge circuit may be changed and it is in this manner that the desired lamp intensity is established.

Drift and change with variations in ambient temperature in the photo isolators in the manual control system and in the phototransistor in the automatic control system does not present a problem provided all photo-sensitive units in one control system drift similarly. The circuit shown in FIG. 5 compensates for light sensing characteristics in the phototransistor utilized therein. Common changes in the operating characteristics of all ballasts in one dimming control system can be compensated for by a single adjustment to the particular variable resistance in the dimming control system which regulates that particular performance characteristic. In addition, various digital techniques could be employed in the dimming control circuit of the present invention in order to pulse the light-sensitive elements therein on and off in response to various control parameters in order to eliminate variations in temperature-dependent operating characteristics.

Figure 6:
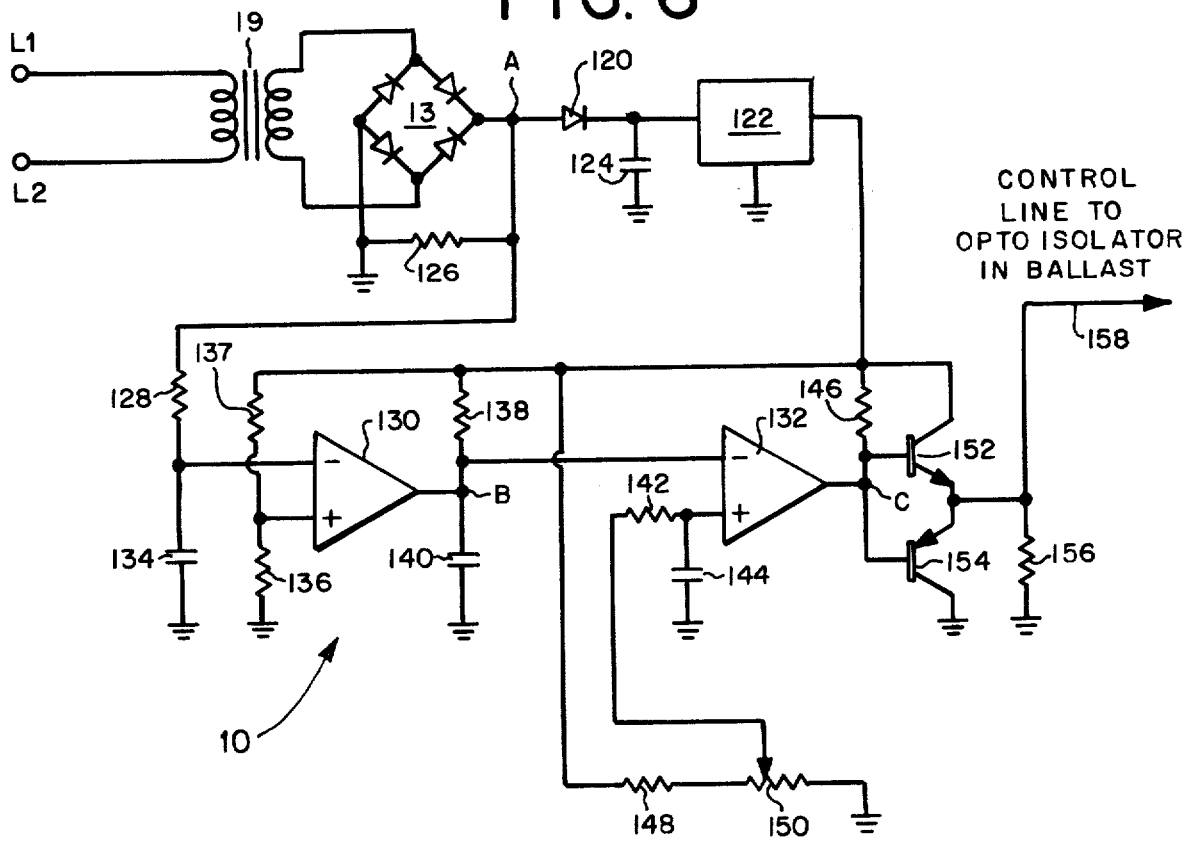
FIG. 6 shows a digital embodiment of the dimmer control circuit of the present invention.

A digital embodiment of the light dimmer for a solid state ballast of the present invention 10 is shown in FIG. 6. The AC line input is provided on lines L1, L2 to transformer 19 which provides an AC signal to rectifier bridge circuit 13. Rectifier bridge circuit 13 provides a full-wave rectified wave form to point A as shown in FIG. 7A. Diode 120 and grounded filter capacitor 124 convert the full-wave rectified signal to a level DC voltage which is provided to voltage regulator 122. Diode 120 isolates filter capacitor 124 from the full-wave rectified output of bridge circuit 13. In the preferred embodiment of the circuit shown in FIG. 6, voltage regulator 122 provides a regulated 12 VDC output.

The output of rectifier bridge circuit 13 is also provided to the negative input of comparator 130 through the filter network comprised of resistor 128 and grounded capacitor 134. Resistor 126 insures that the rectified, filtered input signal to the negative terminal of comparator 130 includes the cusps of the signal at point A. The positive input to comparator 130 is provided by the output of voltage regulator 122 which is divided down by means of resistors 136, 137 before being provided to comparator 130. An output signal is either provided or not provided by comparator 130 in response to the comparison of the signals provided thereto. Resistor 138 and grounded capacitor 140 are coupled in series with the output of voltage regulator 122. Thus, capacitor 140 is charged via resistor 138 and discharges toward point B during the cusp intervals of the input signal provided to the negative input of comparator 130. The charging/discharging of grounded capacitor 140 thus provides a sawtooth-shaped wave form as shown in FIG. 7B at point B in FIG. 6. This sawtooth-shaped signal is then provided to the negative input of comparator 132. The other input to the positive terminal of comparator 132 is provided from voltage regulator 122 via resistors 148, 142 and variable, grounded resistor 150. Variable resistance 150, which in a preferred embodiment is a potentiometer, establishes the DC voltage at the positive input of comparator 132 which, in turn, determines where the sawtooth-shaped wave form of FIG. 7B cuts the DC voltage input. The output of comparator 132 in response to the comparison of the two inputs provided thereto is a series of pulses at point C as shown in FIG. 7C. The width of the individual pulses is determined by the comparison of the DC voltage applied to the positive terminal of comparator 132 and the sawtooth-shaped signal applied to the negative terminal of comparator 132. Comparators 130, 132 include an open collector transistor output with no load transistor coupled thereto. Resistor 142 and grounded capacitor 144 form a filtering network for the input applied to the positive terminal of comparator 132.

NPN transistor 152 and PNP transistor 154 are coupled to the output of voltage regulator 122 and to the output of comparator 132 to form a line driver. An output pulse provided by comparator 132 to point C renders transistor 152 conducting which pulls up the output line close to 12 VDC potential. When an output pulse is not provided to point C by comparator 132, the voltage across resistor 146 is pulled down and transistor 154 is rendered conducting. This results in a pulsed 12 VDC output being provided via transistor 152 to control line 158 and thence to an opto-isolator in the ballast coupled to light dimmer circuit 10. Bleeder resistor 156 pulls output line 158 down to ground when transistor 154 is rendered conducting thus insuring that no output is provided to the ballast to which the control signals are being provided. The pulsed output is coupled via line 158 to an opto-isolator in a ballast (not shown) with the output of the opto-isolator coupled to the output of the lamp circuit 21 as shown in FIG. 3 to form the composite signal provided to the lamp current sensor circuit 38. By thus operating the opto-isolator in the ballast in a pulsed mode, opto-isolator drift and variation caused by environmental factors such as varying temperature is eliminated.

There has thus been provided a dimming control system for a solid state ballast energizing gaseous discharge lamps which provides both manual and automatic control of lamp intensity. Control of a high frequency inverter circuit which energizes the lamps is provided by means of a lamp current sensing feedback signal to which is added a dimming control signal for generating a composite signal which regulates lamp current and hence intensity.

While particular embodiments of the present invention have been shown and described, it will be apparent to those skilled in the art that changes and modifications may be made therein without departing from the invention and its broader aspects. The aim of the appended claims, therefore, is to cover all such changes and modifications as fall within the true spirit and scope of the invention.

I claim:

1. In a high frequency solid state ballast for energizing gaseous discharge lamp means, a dimming circuit for varying the current in said gaseous discharge lamp means comprising:

an inverter circuit for receiving power from a line source and generating a high frequency inverter signal, said inverter circuit coupled to said lamp means for providing said high frequency inverter signal thereto;

first detector circuit means responsive to signals in said lamp means for generating a timing signal in timed relation with said inverter signal;

reference voltage generator means for generating a reference voltage;

current sensor circuit means coupled to said lamp means and responsive to the current flowing therein and coupled to said reference voltage source for receiving and comparing said reference voltage with a signal representing the current in said lamp means and for generating an output signal in response to said comparison;

control logic means responsive to said timing signal and said output signal for actuating said inverter circuit to regulate the current in said lamp means;

a current source derived from said line source; and first variable control means coupled to said current source and to said current sensor circuit means and said lamp means for generating a dimming control signal and combining said dimming control signal with said signal representing the current in said lamp means for providing a composite control signal to said current sensor circuit means wherein said composite control signal is compared with said reference voltage for selectively varying the output signal provided to said control logic means in actuating said inverter circuit and controlling the intensity of said gaseous discharge lamp means.

2. The apparatus of claim 1 wherein said current sensor circuit means includes a differential amplifier having as one input said reference voltage signal and as another input a composite signal comprised of the output of said current source and a signal representing the current in said lamp means for comparing said reference and composite signals and providing said output signal to said commutation circuit in response to said comparison.

3. The apparatus of claim 1 further comprising rectifier circuit means receiving power from said line source for generating a rectified current and for applying the same to said inverter circuit and said current source.

4. The apparatus of claim 1 further comprising second variable control means coupled to said first variable control means for selectively establishing the output signal level for gaseous discharge lamp means turn-off.

5. The apparatus of claim 4 wherein said first and second variable control means each include a selectively variable resistance coupled to said current source for controlling the current provided to said current sensor circuit means.

6. The apparatus of claim 1 further comprising manual switch means coupled to said line source and to said first variable control means for selectively varying the current in said current source and said output signal to said control logic means for manually controlling the current in and the intensity of said gaseous discharge lamp means.

7. The apparatus of claim 1 wherein said first variable control means includes light level detecting means for sensing ambient light level for automatically controlling the current in and the intensity of said gaseous discharge lamp means.

8. The apparatus of claim 7 wherein said first variable control means further includes a balanced bridge circuit having first and second branches, said first branch including said light level detecting means and said second branch including variable resistance means for selectively balancing said bridge in automatically controlling the current in and the intensity of said gaseous discharge lamp means.

9. In a solid state ballast for energizing gaseous discharge lamp means by means of an alternating current line source, a dimming circuit for varying the intensity of said gaseous discharge lamp means comprising:

rectifier circuit means coupled to said line source for generating a direct current output signal;

an inverter circuit coupled to said rectifier circuit means for receiving said direct current output signal and for generating a high frequency inverter signal, said inverter circuit coupled to said lamp means for providing said high frequency inverter signal thereto;

first detector circuit means responsive to signals in said lamp means for generating a timing signal in timed relation with said inverter signal;

current sensor circuit means coupled to said lamp means and responsive to the current flowing therein for generating an output signal representative of the magnitude of said current;

control logic means responsive to said timing signal and said output signal for actuating said inverter circuit to regulate the current in said lamp means;

first variable control means coupling said rectifier circuit means to said current sensor circuit means for varying the output signal provided to said commutation circuit means in controlling the current in and the intensity of said gaseous discharge lamp means;

selectively variable manual switch means coupling said line source to said first variable control means for manually varying said output signal therefrom and the intensity of said gaseous discharge lamp means;

light level detecting means coupled to said first variable control means, said light level detecting means responsive to ambient light level for varying the output signal of said first variable control means in response thereto in automatically controlling the intensity of said gaseous discharge lamp means; and second variable control means coupled to said first variable control means for selectively establishing the output signal level for gaseous discharge lamp means turn-off.

10. In a solid state ballast for energizing gaseous discharge lamp means, a dimming circuit for varying the current in said gaseous discharge lamp means comprising:

an inverter circuit for receiving power from a line source and generating a high frequency inverter signal, said inverter circuit coupled to said lamp means for providing said high frequency inverter signal thereto;

first detector circuit means responsive to signals in said lamp means for generating a timing signal in timed relation with said inverter signal;

current sensor circuit means coupled to said lamp means and responsive to the current flowing therein for generating an output signal representative of the magnitude of said current;

control logic means responsive to said timing signal and said output signal for actuating said inverter circuit to regulate the current in said lamp means;

a selectively variable current source; and optoisolator coupling means for coupling said variable current source to said current sensor circuit means in providing a composite signal comprised of a feedback signal from said lamp means and a control signal from said variable current source to said current sensor circuit means for selectively controlling the output signal of said current sensor circuit means to said control logic means in regulating the current in said lamp means, wherein said line source and said gaseous discharge lamp means are electrically isolated from said variable current source.

11. The apparatus of claim 10 wherein said optoisolator coupling means includes a light emitting diode electrically coupled to said variable current source and optically coupled to a phototransistor, said phototransistor electrically coupled to said current sensor circuit means and responsive to the control signal output from said variable current source.

12. In a solid state ballast for energizing gaseous discharge lamp means from an alternating line source input, said ballast including rectifier circuit means and inverter circuit means for converting said alternating line source input to a high frequency signal for driving said gaseous discharge lamp means, said ballast further including control logic means coupled to said inverter circuit means and to lamp current sensor means and responsive to the current in said gaseous discharge lamp means as provided to said lamp current sensor means for regulating drive signals provided to said inverter circuit means and the current in said gaseous discharge lamp means, a digital dimming circuit for varying the current in said gaseous discharge lamp means comprising:

a control circuit coupled to said rectifier circuit means for providing a dimming control signal in response to control inputs thereto;

a pulse forming circuit coupled to said control circuit and responsive to said dimming control signal for generating a first pulsed output signal representing said dimming control signal; and optoisolator means coupled to said pulse forming circuit for receiving said first pulsed output signal and for generating a second pulsed output signal in response thereto, said first and second pulsed output signal being electrically isolated from one another, wherein said optoisolator means is coupled to said lamp current sensor means for providing a digital dimming signal thereto.

* * * * *